US006537110B1

(12) United States Patent
Korsunsky et al.

(10) Patent No.: US 6,537,110 B1
(45) Date of Patent: Mar. 25, 2003

(54) STACKED MODULAR JACK ASSEMBLY HAVING HIGHLY MODULARIZED ELECTRONIC COMPONENTS

(75) Inventors: Iosif R. Korsunsky, Harrisburg, PA (US); Kevin E. Walker, Hershey, PA (US); James H. Hyland, Hummelstown, PA (US)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 10/242,002

(22) Filed: Sep. 11, 2002

Related U.S. Application Data

(63) Continuation-in-part of application No. 10/037,061, filed on Nov. 8, 2001.

(51) Int. Cl.[7] ..... H01R 24/00

(52) U.S. Cl. ..... 439/676; 439/38; 439/76.1; 439/620; 439/941

(58) Field of Search ..... 439/76.1, 676, 439/941, 541.5, 607, 608, 609, 610, 620, 490, 38

(56) References Cited

U.S. PATENT DOCUMENTS 5,069,641 A 12/1991 Sakamoto et al.
5,587,884 A 12/1996 Raman
5,647,767 A 7/1997 Scheer et al.
6,302,741 B1 * 10/2001 Fasold et al. ..... 439/620
6,350,152 B1 * 2/2002 Belopolsky et al. ..... 439/541.5
6,425,781 B1 * 7/2002 Bernstein et al. ..... 439/490
6,428,361 B1 * 8/2002 Imschweiler et al. ..... 439/676

OTHER PUBLICATIONS

MagJack Family of Modular Jacks with Integrated Magnetics, http://www.Stewartconnector.com/pdfs/magjkfy.pdf.

* cited by examiner

*Primary Examiner*—Renee Luebke
*Assistant Examiner*—Truc Nguyen
(74) *Attorney, Agent, or Firm*—Wei Te Chung

(57) ABSTRACT

An electrical connector assembly (1) includes an electrical subassembly (3) and an insulating housing (2) encasing the electrical subassembly. The electrical subassembly includes first and second printed circuit boards (320, 340) each having a number of contacts (322, 342) soldered thereon, a pair of magnetic modules (300, 300') respectively electrically connecting with the corresponding contacts, and a metal plate (4) sandwiched between the magnetic modules. The magnetic modules are joined together by the metal plate before they are soldered to the first and second printed circuit boards.

8 Claims, 9 Drawing Sheets

STACKED MODULAR JACK ASSEMBLY HAVING HIGHLY MODULARIZED ELECTRONIC COMPONENTS

CROSS-REFERENCE TO RELATED APPLICATIONS

This patent application is a continuation-in-part of U.S. patent application Ser. No. 10/037,061, filed on Nov. 8, 2001; and is related to a U.S. Patent Application entitled "STACKED MODULAR JACK ASSEMBLY HAVING BUILT-IN CIRCUIT BOARDS; a U.S. Patent Application filed Aug. 29, 2002 and entitled "STACKED MODULAR JACK ASSEMBLY HAVING IMPROVED POSITIONING MEANS", invented by the same inventors as this patent application; a U.S. Patent Application entitled "HIGH FREQUENCY MODULAR JACK CONNECTOR", invented by the same inventors as this patent application; and a U.S. Patent Application titled "STACKED MODULAR JACK ASSEMBLY HAVING IMPROVED ELECTRIC CAPABILITY", invented by the same inventors as this patent application, and all assigned to the same assignee with this application.

BACKGROUND OF THE INVENTION

1. Field of the Invention

The present invention relates to a stacked modular jack assembly, and particularly to a stacked LAN (Local Area Network) jack assembly having highly modularized electronic components.

2. Description of Related Art

It is quite common to use modular jacks for the data transmission in high speed applications such as IEEE 802.3 10Base-T or 100Base-T local area networks. A common problem to these high speed modular jacks is their tendency to emit high frequency radiation. There is also a need to provide means for suppressing undesirable noise.

Noise suppressors or signal conditioning components, such as common mode choke coils, are known in the art. The noise suppressors are mounted on a mother board on which the modular jack is seated. The noise suppressors are electrically connected with the modular jack by wires on the mother board. However, such signal conditioning components consume board real estate, which could otherwise be used for other circuitry. Furthermore, since the signal conditioning components are distant from the modular jack, the signal traces required to route the signals from the modular jack to the signal conditioning components degrade the signal integrity somewhat, thereby lowering the signal-to-noise ratio.

Stewart, headquartered in Glen Rock, Pennsylvania, posted an article, entitled "MagJack Family of Modular Jacks with Integrated Magnetics" on the Internet website address, http://www.stewartconnector.com/pdfs/magjkfy.pdf. This article introduces a series of magjack modular connectors each having integrated magnetic components housed within a jack body for protecting signals from internally and externally generated noise. Because the magnetic components are integrated into the jack itself, valuable board real estate is obviously saved.

U.S. Pat. No. 5,069,641, issued to Sakanmoto et al, discloses a modular jack assembly comprising a dielectric housing and a printed circuit board disposed within the housing. The printed circuit board contains noise suppressors. A common mode choke coil and a three-terminal capacitor arrangement is used as a typical noise suppressor.

The printed circuit board is fitted with contactors and terminals respectively for contacting with a modular plug and mounting the modular jack assembly on a mother board. The contactors and the terminals are electrically connected with the noise suppressors by wires on the printed circuit board.

U.S. Pat. Nos. 5,587,884 and 5,647,767, both assigned to The Whitaker Corporation, each disclose a modular jack assembly comprising an insulating housing and an insert subassembly received in the housing. The insert subassembly includes front and rear insert members. The front insert member has contact terminals encapsulated therein for mating with a modular plug. The rear insert member has a printed circuit board and leads encapsulated therein. The printed circuit board contains signal conditioning components such as common mode choke coils. The leads extend downwardly for electrically connecting to external circuits, such as a mother board. The terminals and the leads are soldered to the printed circuit board and electrically connected with the signal conditioning components by wires on the printed circuit board.

Recently, in order to save valuable real estate of mother boards in electronic devices, modular jacks are developed to be arranged in a stacked manner. The stacked modular jack has upper and lower ports each receiving contacts therein for mating with a modular plug. When the stacked modular jack is used in high speed applications, a number of signal conditioning components needed for the upper and lower ports are respectively mounted onto internal printed circuit boards for suppressing noise, thereby achieving better signal transmission performance. However, it is complicated and time-consuming for respectively assembling the signal conditioning components to the corresponding printed circuit boards, thereby increasing the manufacturing cost.

Hence, a stacked modular jack assembly having highly modularized electric components is required to overcome the disadvantages of the prior art.

SUMMARY OF THE INVENTION

It is an object of the present invention to provide a stacked modular jack assembly having highly modularized electronic components for simplifying assemblage, thereby saving the manufacturing cost.

It is another object of the present invention to provide a stacked modular jack assembly having electronic components which are highly modularized for being simultaneously assembled to different internal printed circuit boards.

In order to achieve the objects set forth, an electrical connector assembly in accordance with the present invention comprises an insulating housing and an electrical subassembly disposed within the housing. The electrical subassembly includes first and second printed circuit boards each having a plurality of contacts soldered thereon, a pair of magnetic modules respectively electrically connecting with the first and second contacts, and a metal plate sandwiched between the magnetic modules. The magnetic modules are joined together before they are respectively soldered to the first and second printed circuit boards.

Other objects, advantages and novel features of the invention will become more apparent from the following detailed description when taken in conjunction with the accompanying drawings.

DETAILED DESCRIPTION OF THE INVENTION

Reference will now be made in detail to the preferred embodiment of the present invention.

Figure 1:
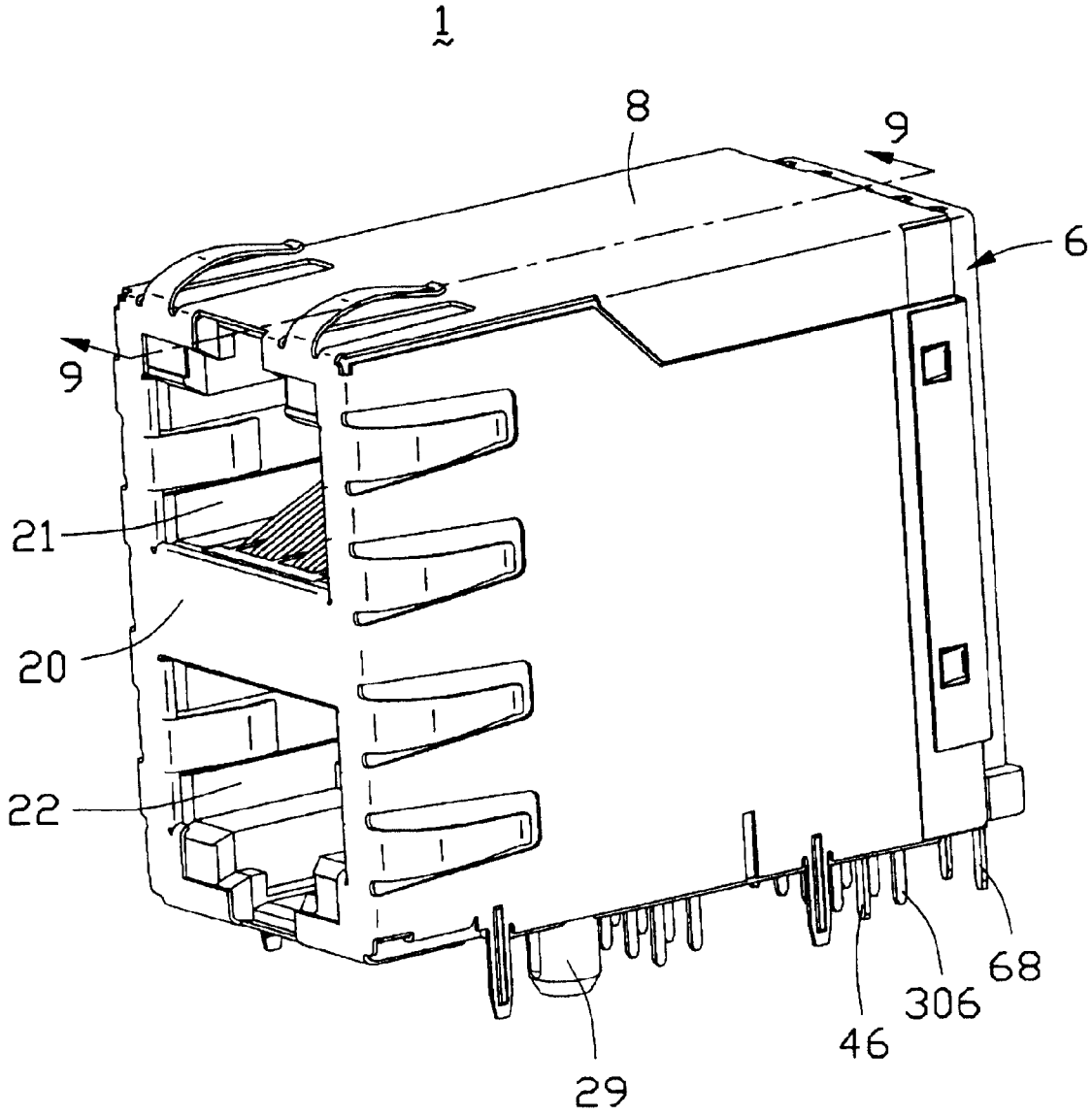
FIG. 1 is a perspective view of an electrical connector assembly in accordance with the present invention.
Figure 2:
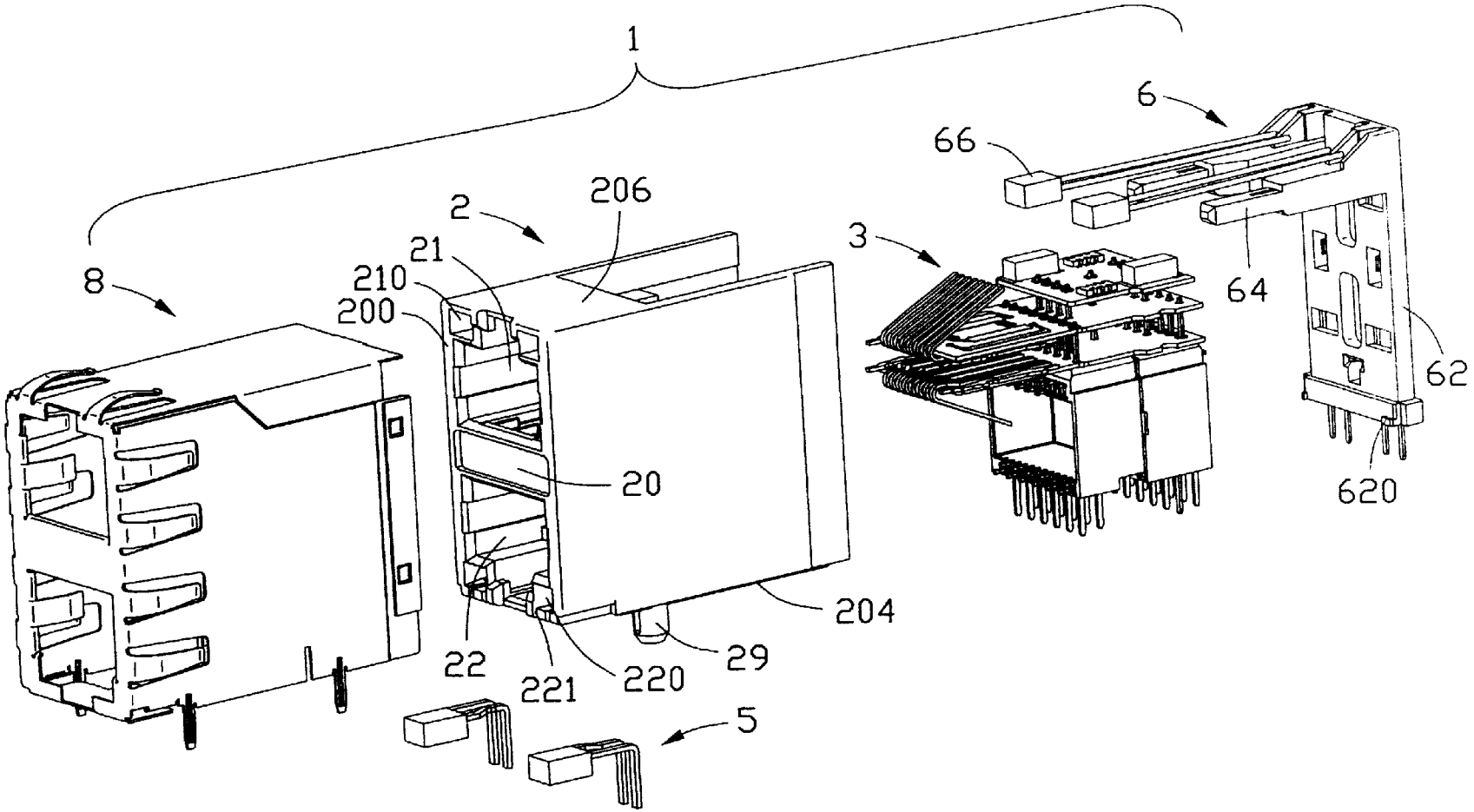
FIG. 2 is a front exploded perspective view of the connector assembly of FIG. 1.

Referring to FIGS. 1 and 2, an electrical connector assembly 1 in accordance with the present invention comprises an insulating housing 2, an electrical subassembly 3 disposed within the insulating housing 2, an LED (Light-Emitting Diode) module 6 secured to the housing 2 for functioning as a visual indicator and a shell 8 optionally enclosing the housing 2 for EMI (Electromagnetic Interference) protection. In the preferred embodiment of the present invention, the electrical connector assembly 1 is a stacked LAN (Local Area Network) jack assembly for high speed signal transmission.

Figure 3:
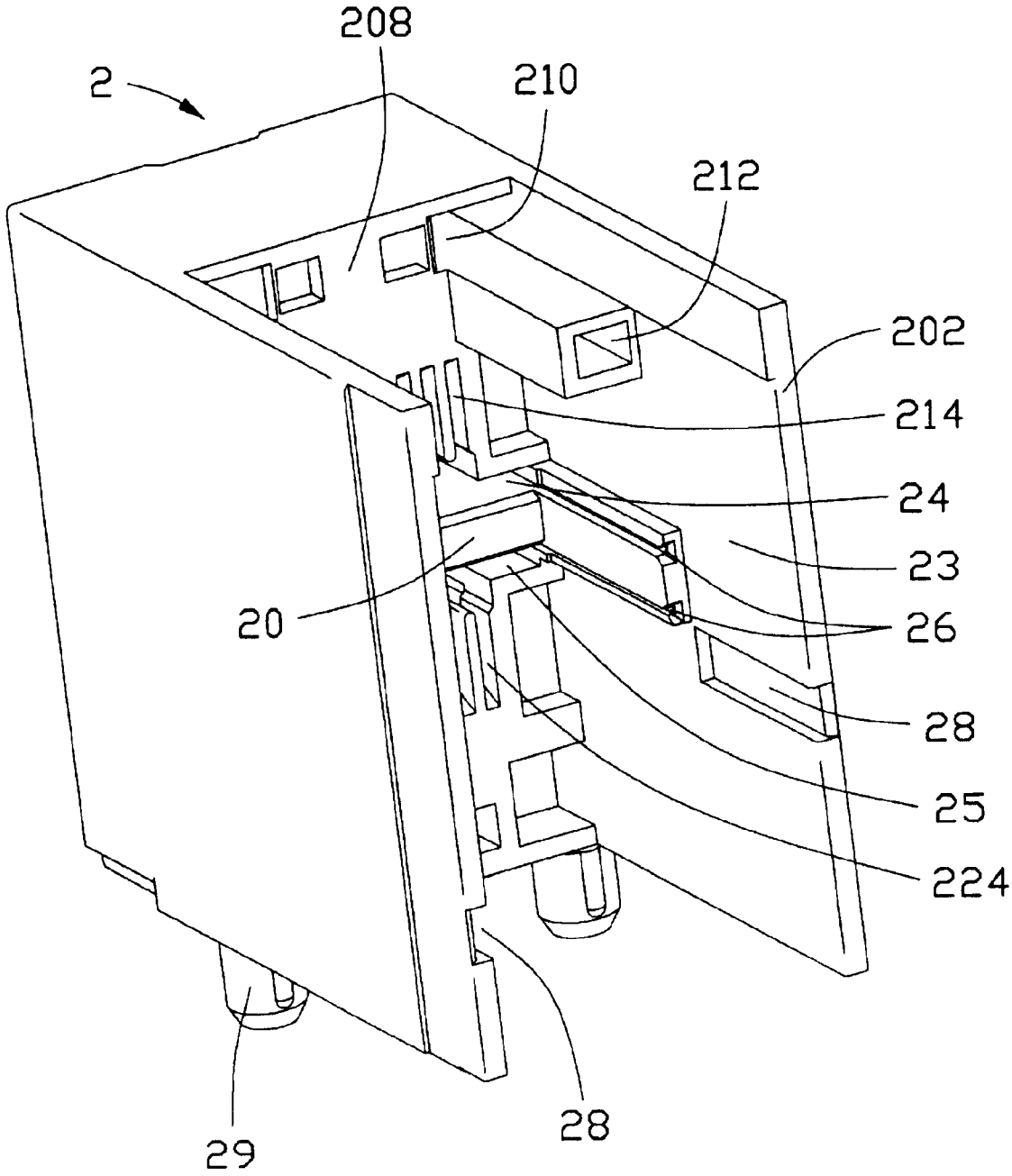
FIG. 3 is a rear perspective view of an insulating housing of the connector assembly.

Referring to FIG. 3, the insulating housing 2 defines upper and lower receiving cavities 21, 22 in a front mating face 200 for receiving modular plugs (not shown), and a receiving space 23 in a rear face 202 communicating with the upper and lower receiving cavities 21, 22 through upper and lower channels 24, 25. The upper and lower receiving cavities 21, 22 share a partition wall 20 therebetween.

The housing 2 defines a pair of upper and lower holes 210, 220 located at four corners of the front mating face 200. Each lower hole 220, near a bottom mounting face 204, extends into the housing 2 for a predetermined length for receiving therein a standard LED 5. The LED 5 is inserted into the corresponding lower hole 220 with its right-angled legs fitted in slits 221 formed in the bottom mounting face 204. Each upper hole 210, near a top face 206, extends in the housing 2 from the front mating face 200 to the receiving space 23. The housing 2 defines a plurality of upper and lower slits 214, 224 extending through an intermediate wall 208 between the receiving cavities 21, 22 and the receiving space 23.

The housing 2 defines two pairs of grooves 26 extending in a back-to-front direction of the housing 2 beside the receiving space 23. The grooves 26 extend into the upper and lower receiving cavities 21, 22 through the upper and lower channels 24, 25. The housing 2 further defines a pair of recesses 28 beside the receiving space 23 and offset from each other in a vertical direction. In addition, the housing 2 has a pair of positioning posts 29 downwardly extending from the bottom mounting face 204 for being received in corresponding holes of a mother board (not shown) on which the connector assembly 1 is to be mounted.

Figure 5:
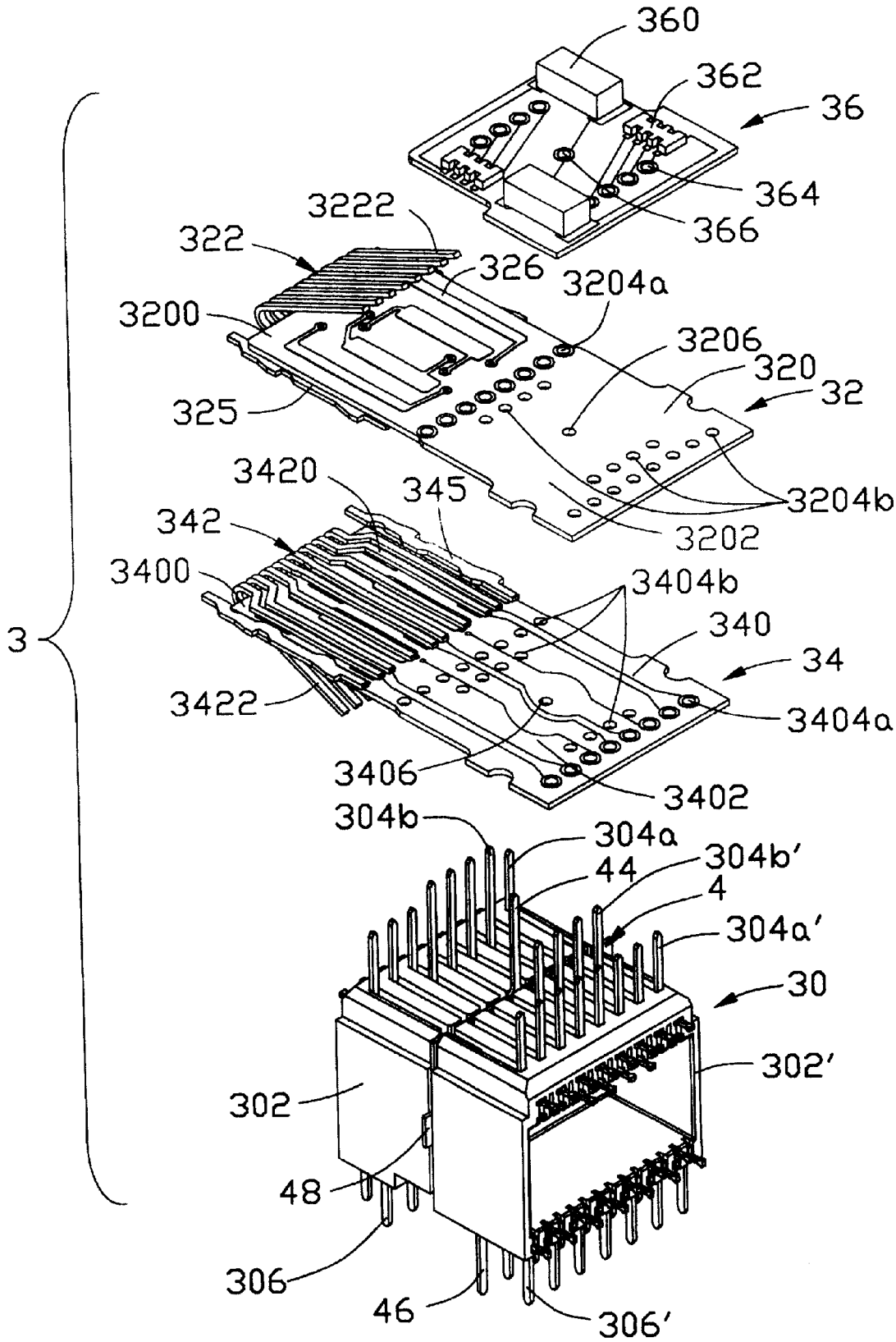
FIGS. 5 and 6 are exploded views of the electrical subassembly taken from different perspectives.
Figure 6:
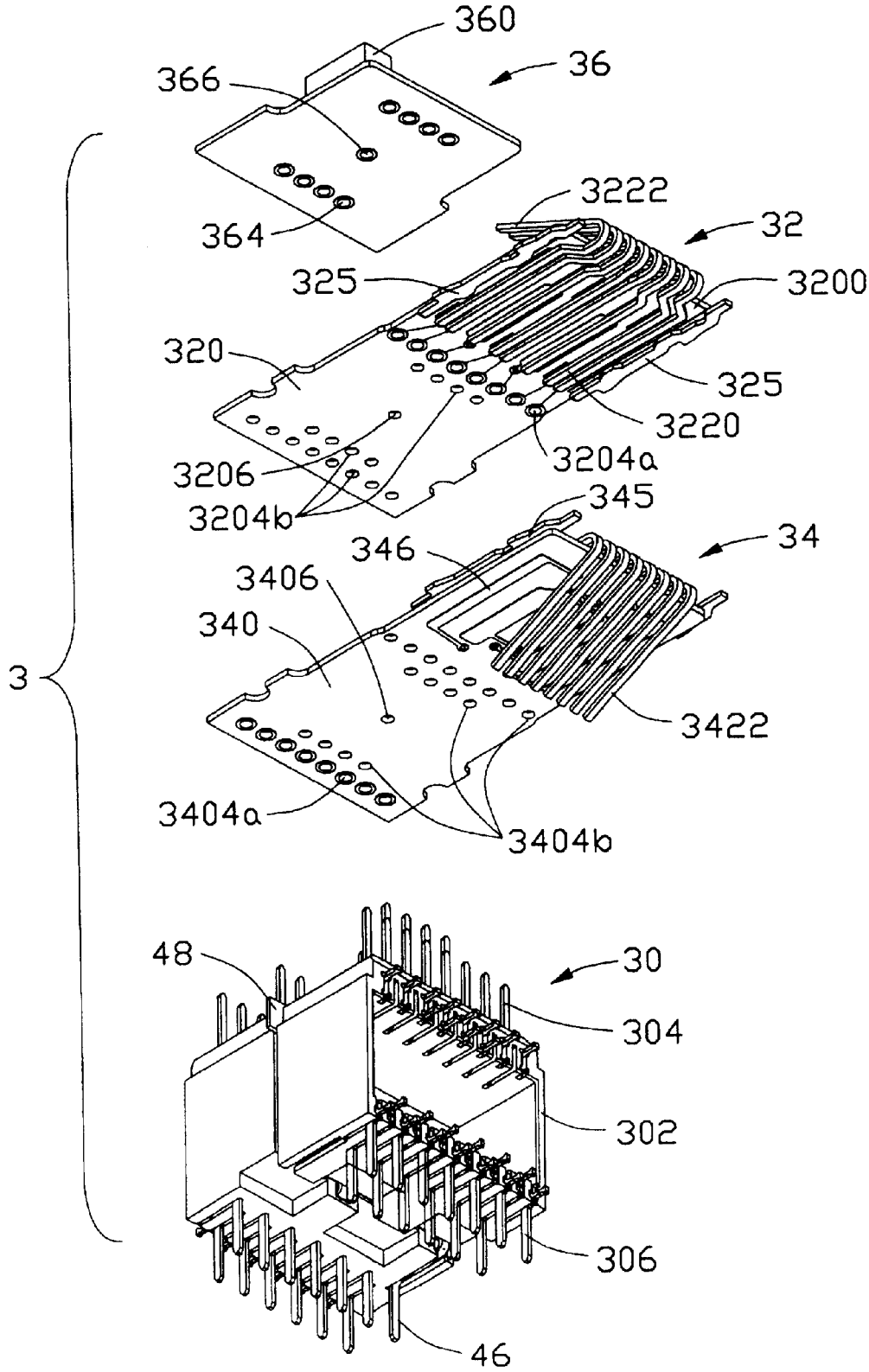

Referring to FIGS. 5 and 6 in conjunction with FIG. 2, the electrical subassembly 3 comprises a magnetic module assembly 30, upper and lower contact array assemblies 32, 34 positioned above the magnetic module assembly 30, and a third printed circuit board (PCB) 36 disposed above the upper contact array assembly 32.

The upper and lower contact array assemblies 32, 34 are identical in structure. The upper and lower contact array assemblies 32, 34 have respective first and second printed circuit boards (PCBs) 320, 340, respective first and second contacts 322, 342 soldered on the first and second PCBs 320, 340, and respective first and second side conductors 325, 345 soldered on opposite edges of the first and second PCBs 320, 340. The first and second contacts 322, 342 have respective first and second tail portions 3220, 3420 respectively soldered on solder pads of the first and second PCBs 320, 340, and first and second mating portions 3222, 3422 extending from the respective first and second tail portions 3220, 3420. The first and second PCBs 320, 340 have respective conductive traces 326, 346 on a surface opposite to the solder pads of the first and second PCBs 320, 340. The solder pads to which the first and second contacts 322, 342 are soldered, and the conductive traces 326, 346 are so designed and arranged that they can influence cross-talk between the first contacts 322 and the second contacts 342, respectively. The related description of the solder pads and the conductive traces on the first and second PCBs 320, 340 are disclosed in patent application Ser. No. 10/037,061 filed on Nov. 8, 2001 and entitled "RJ MODULAR CONNECTOR HAVING SUBSTRATE HAVING CONDUCTIVE TRACE TO BALANCE ELECTRICAL COUPLINGS BETWEEN TERMINALS". The disclosures of the '061 application are wholly incorporated herein by reference.

The first and second PCBs 320, 340 define first and second plated through holes 3204*a*, 3404*a* and first and second clear through holes 3204*b*, 3404*b* at respective first and second rear portions 3202, 3402, and respective first and second clear apertures 3206, 3406 therein.

The third PCB 36 contains a plurality of signal conditioning components such as capacitors 360 and resistors 362 used for signal conditioning and termination. The third PCB 36 defines a plurality of third plated through holes 364 and a third plated aperture 366 therein.

Figure 7:
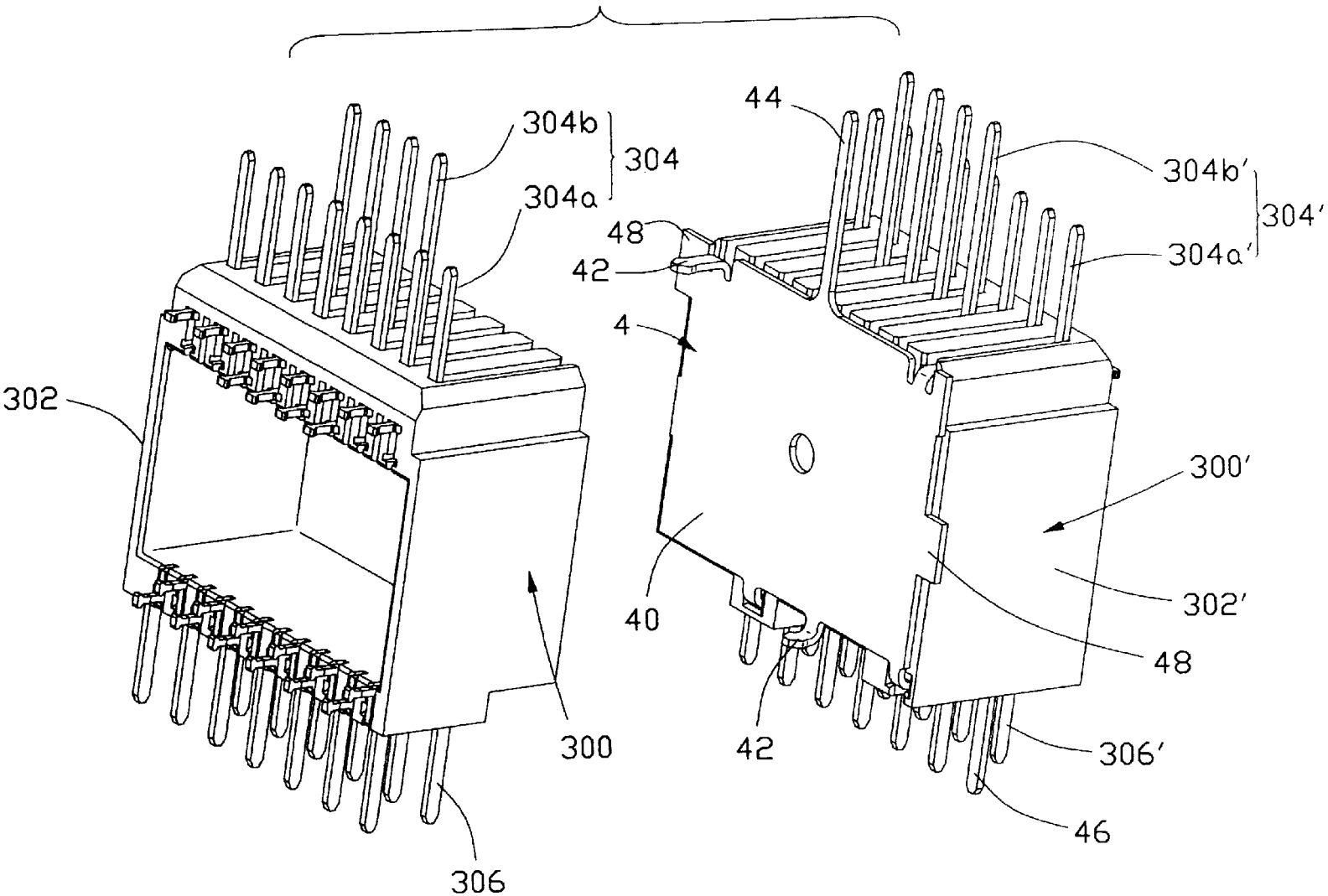
FIG. 7 is a partially exploded view of a magnetic module assembly of the present invention.
Figure 8:
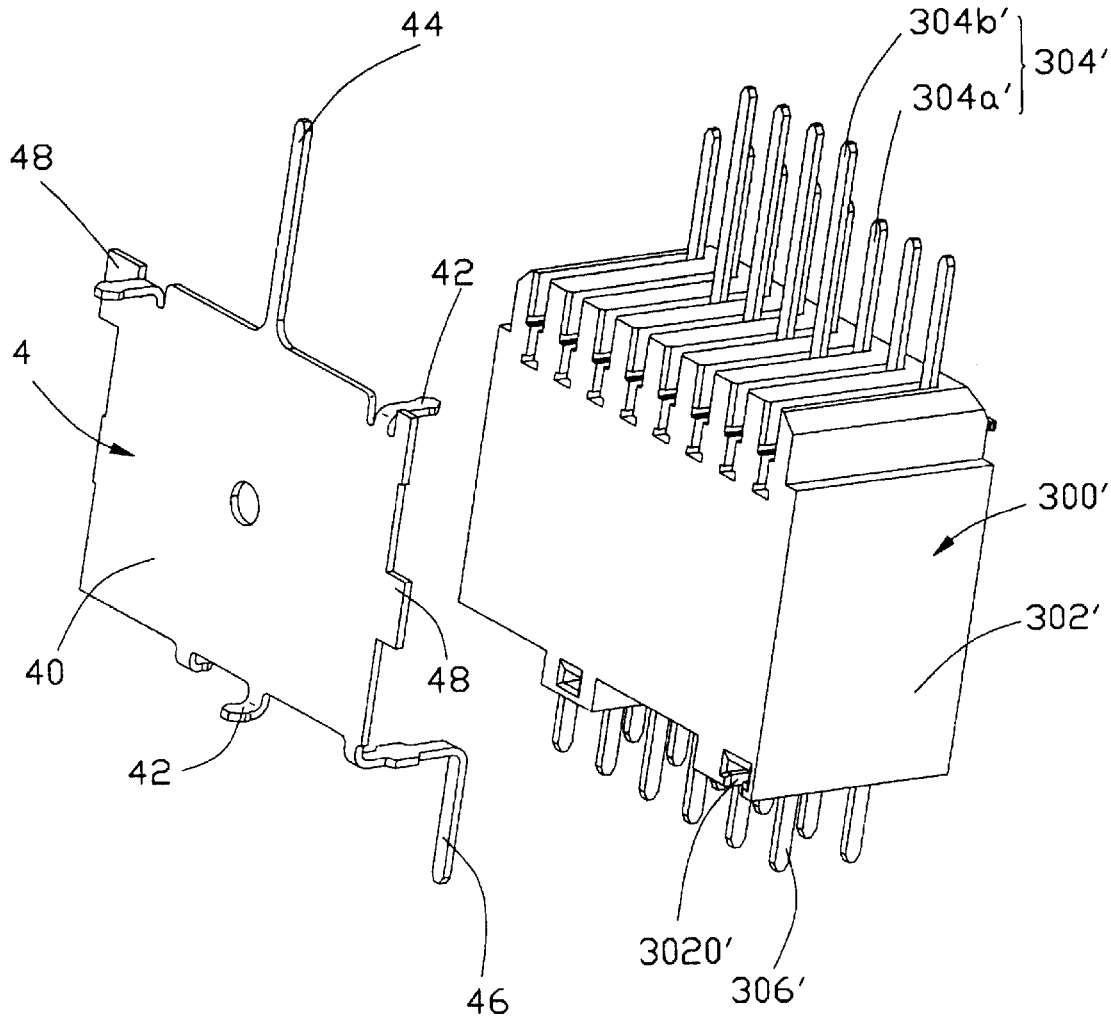
FIG. 8 is a perspective view showing a rear magnetic module to be attached to a metal plate of the present invention.
Figure 9:
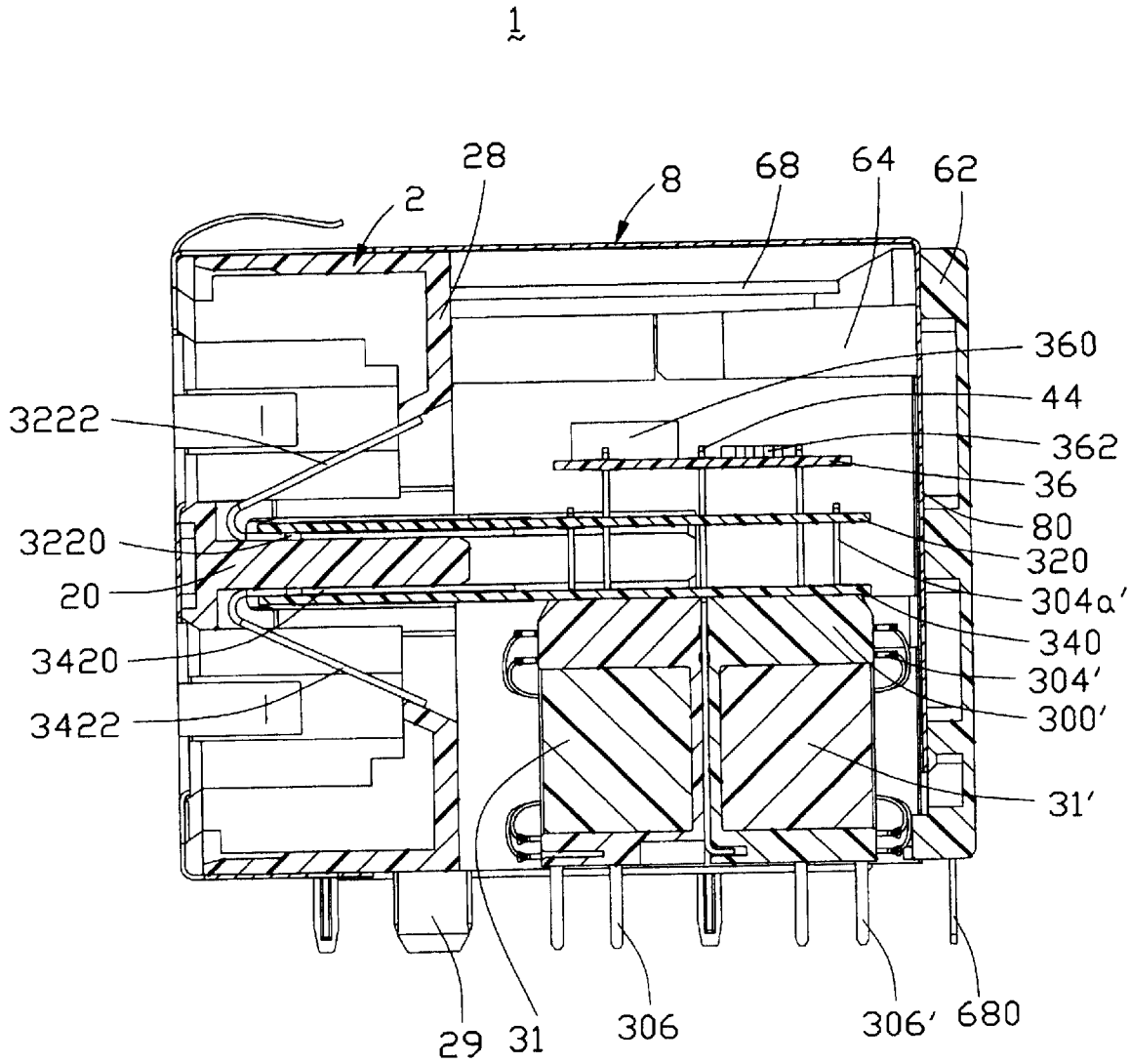
FIG. 9 is a cross-sectional view of the connector assembly taken along section line 9—9 in FIG. 1.

Referring to FIGS. 7 and 8, the magnetic module assembly 30 includes front and rear magnetic modules 300, 300' for respectively soldering to the first and second printed circuit boards 320, 340. The front and rear magnetic modules 300, 300' are identical in structure. The front and rear magnetic modules 300, 300' each include a container 302 (302'), upper and lower pins 304, 306 (304', 306') respectively disposed on upper and lower portions of the container 302 (302'), and a plurality of magnetic coils 31 (31') housed within the container 302 (302') and connecting with the upper and lower pins 304, 306 (304', 306'), which is schematically shown in FIG. 9. The upper pins 304 (304') are divided into first and second pin arrays 304*a*, 304*b* (304*a'*, 304*b'*).

The magnetic module assembly 30 further includes a metal plate 4 for joining the front and rear magnetic modules 300, 300' together before they are soldered to the first and second printed circuit boards 320, 340. The metal plate 4 has a plane body 40 sandwiched between the front and rear magnetic modules 300, 300', and a plurality of tabs 42 extending forwardly and rearwardly from top and bottom edges of the plane body 40 and received in slots of the containers 302, 302' for securing the front and rear magnetic modules 300, 300' together. Upper and lower legs 44, 46 respectively extend upwardly and downwardly from top and bottom edges of the plane body 40. The lower leg 46 is bent to form a right-angled tail for being retained in a slit 3020' of the rear magnetic module 300'. The metal plate 4 further forms a pair of offsetting projections 48 respectively on side edges thereof. The metal plate 4 electrically shield and isolate the front and rear magnetic modules 300, 300' for reducing crosstalk thereof.

The front and rear magnetic modules 300, 300' are simultaneously assembled to the first and second printed circuit board 320, 340 via the metal plate 4. The first upper pin array 304*a'* of the rear magnetic module 300' is soldered to the second plated through holes 3404*a* of the second PCB 340 and electrically connected with the second contacts 342 by wires (not labeled) on the second PCB 340. The first upper pin array 304*a* of the front magnetic module 300 first penetrates through the second clear through holes 3404*b* and then are soldered to the first plated through holes 3204*a* of the first PCB 320 and electrically connected with the first contacts 322 by wires (not labeled) on the first PCB 320. The second upper pin arrays 304*b*, 304*b'* of the front and rear magnetic modules 300, 300' penetrate through the second and first clear through holes 3404*b*, 3204*b* to be soldered to the third plated through holes 364 of the third PCB 36. At the same time, the upper leg 44 of the metal plate 4 penetrates through the second and first clear apertures 3406, 3206 of the second and first PCBs 340, 320 to be soldered to the third plated aperture 366 of the third PCB 36.

It can be seen that when the modular jack assembly 1 engages with the modular plugs, noise received through the first and second contacts 322, 342 is respectively reduced by the magnetic coils 31, 31' of the front and rear magnetic modules 300, 300'.

It is noted that the second upper pin arrays 304*b*, 304*b'* of the front and rear magnetic modules 300, 300' are connected to the capacitors 360 and the resistors 362 via circuit traces (not labeled) on the third PCB 36. The third plated through hole 366 is defined in the circuit trace of the third PCB 36, and the upper and lower legs 44, 46 of the metal plate 4 function as grounding terminals for respectively soldering with the third PCB 36 and the mother board. A majority of the upper and lower pins 304, 306 (304',306') are connected with each other through the magnetic coils 31 (31'). The signals received in the first and second contacts 322, 342 are conditioned by the capacitors 360 and the resistors 362 on the third PCB 36.

Figure 4:
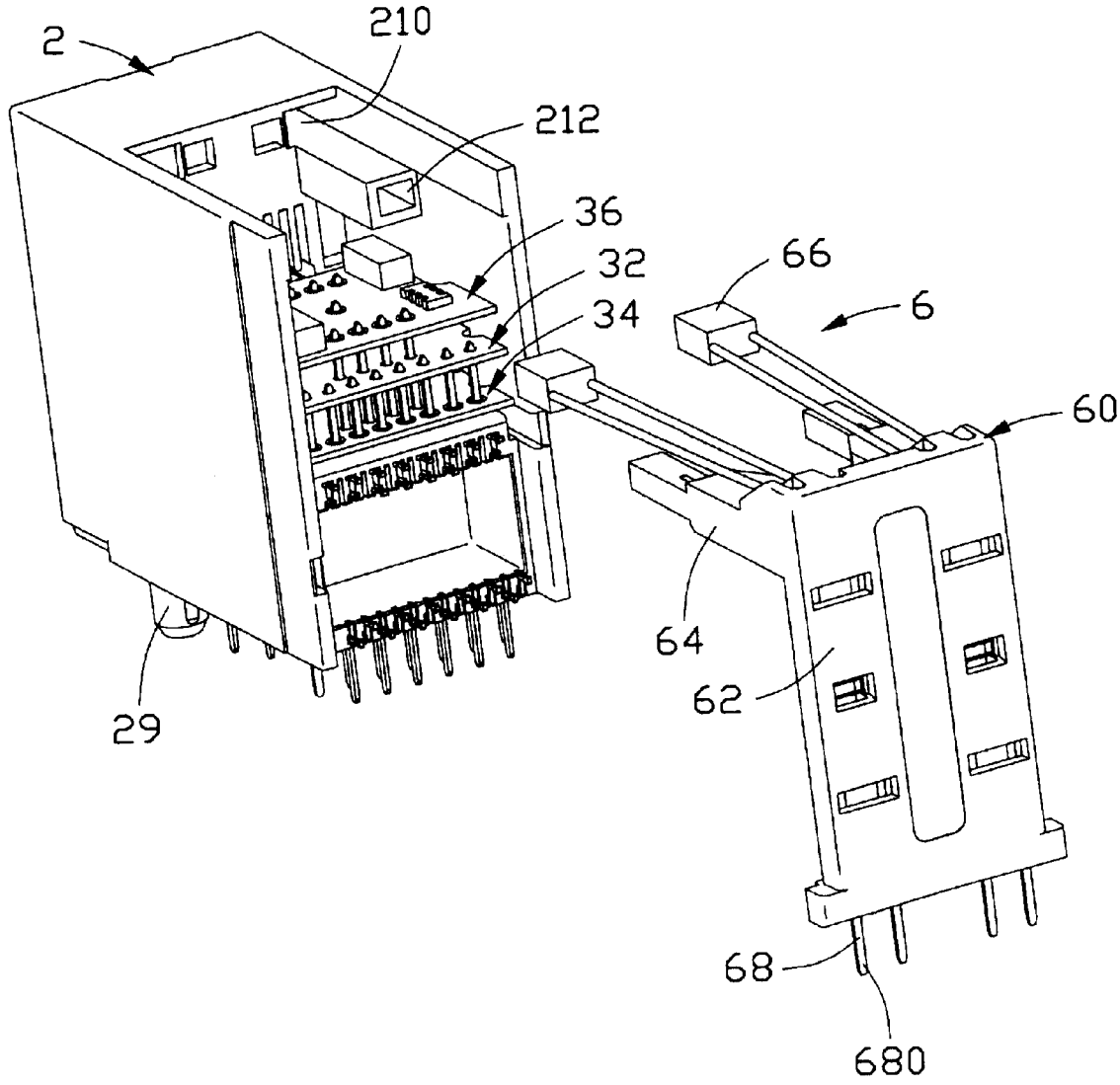
FIG. 4 is a partially assembled view of the connector assembly showing an electrical subassembly of the present invention disposed within the insulating housing and an LED module to be assembled within the insulating housing.

Referring to FIGS. 2 and 4, the LED module 6 includes an insulating carrier 60 with leads 68 overmolded therein and a pair of standard LEDs 66 electrically connecting with the leads 68. The carrier 60 has a base portion 62 and a pair of limbs 64 forwardly perpendicularly extending from a top edge of the base portion 60. The leads 68 have legs 680 downwardly extending beneath a bottom edge of the base portion 62 for soldering to the mother board.

In assembly, the electrical subassembly 3 is inserted into the housing 2 through the receiving space 23 in the rear face 202. The first and second PCBs 320, 340 of the upper and lower contact array assemblies 32, 34 move forwardly respectively through the upper and lower channels 24, 25 of the housing 2 until the first and second mating portions 3222, 3422 of the first and second contacts 322, 342 respectively extend into the upper and lower receiving cavities 21, 22 through the upper and lower slits 214, 224. The first and second rear portions 3202, 3402 of the first and second PCBs 320, 340, the magnetic module assembly 30 and the third PCB 36 are disposed in the receiving space 23. During this procedure, the first and second side conductors 325, 345 on the first and second PCBs 320, 340 are received in the corresponding grooves 26 for positioning and guiding the upper and lower contact array assemblies 32, 34. The pair of offsetting projections 48 of the metal plate 4 is received in the offsetting recesses 28 of the housing 2 for positioning the electrical subassembly 3. Therefore, the electrical subassembly 3 is ensured to be accurately inserted into the housing 2. Finally, the serrations on the first and second side conductors 325, 345 of the first and second PCBs 320, 340 have an interferential engagement with the housing 2 in the grooves 26.

The shell 8 then encloses the housing 2 for EMI protection. The LED module 6 is finally secured to the housing 2 in a back-to-front direction. The LEDs 66 are inserted into the upper holes 210 of the housing 2 and can be visible from the front mating face 200. The limbs 64 are received in slots 212 (FIG. 3) defined below the upper holes 210 of the housing 2. The base portion 62 abuts against a rear wall 80 (FIG. 9) of the shell 8 with protrusions 620 (FIG. 2) keying into the housing 2.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An electrical connector assembly comprising:

an insulating housing; and an electrical subassembly assembled to the insulating housing, the electrical subassembly comprising:

first and second contact array assemblies each having a plurality of contacts;

a pair of magnetic modules electrically connecting with the contacts of the first and second contact array assemblies, respectively; and a metal plate sandwiched between the magnetic modules, the magnetic modules being joined together by the metal plate before they are respectively connected to the contacts of the first and second contact array assemblies.

wherein each of the magnetic module includes a container, upper and lower pins disposed on upper and lower portions of the container and magnetic coils in the container connecting with the upper and lower pins; and wherein the container of the each magnetic module defines slots therein, and the metal plate has tabs received in the slots of the magnetic modules for joining the magnetic modules together.

2. The electrical connector assembly as claimed in claim 1, wherein each contact array assembly includes a printed circuit board, and the contacts are attached on the printed circuit board.

3. The electrical connector assembly as claimed in claim 1, wherein the metal plate has offsetting projections for positioning the electrical subassembly into the insulating housing.

4. The electrical connector assembly as claimed in claim 1, wherein the magnetic modules are respectively electrically connected with the contacts on one of the first and second printed circuit boards via some of the upper pins.

5. The electrical connector assembly as claimed in claim 4, wherein the electrical connector assembly further comprises a third printed circuit board having noise suppressors thereon.

6. The electrical connector assembly as claimed in claim 5, wherein the magnetic modules are electrically connected with the noise suppressors via the others of the upper pins thereof.

7. The electrical connector assembly as claimed in claim 6, wherein the metal plate has upper and lower legs respectively for connecting with the third printed circuit board and a mother board.

8. An electrical connector assembly comprising:

an insulative housing;

an electrical subassembly assembled to the housing and comprising:

upper and lower printed circuit boards stacked with each other;

a plurality of upper contacts mechanically and electrically connected to the upper printed circuit board;

a plurality of lower contacts mechanically and electrically connected to the lower printed circuit board; and a pair of magnetic modules side by side both located under the lower printed circuit board while respectively mechanically and electrically connected to the upper and lower printed circuit board; wherein each of said magnetic modules include a plurality of pins extending from a lower portion thereof for mounting to a mother board on which the housing is seated;

wherein each of said magnetic modules includes a plurality of pins extending from an upper portion thereof for connecting to a corresponding printed circuit board; and wherein the lower printed circuit board defines a plurality of through holes for allowing some of the upper pins to extend therethrough while without involvement of any electrical issues.

* * * * *